US008449104B2

(12) United States Patent
Okazawa

(10) Patent No.: US 8,449,104 B2
(45) Date of Patent: May 28, 2013

(54) CONVEYANCE APPARATUS AND RECORDING APPARATUS

(75) Inventor: Keiji Okazawa, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 12/716,061

(22) Filed: Mar. 2, 2010

(65) Prior Publication Data

US 2010/0225723 A1 Sep. 9, 2010

(30) Foreign Application Priority Data

Mar. 4, 2009 (JP) ..... 2009-050920

(51) Int. Cl.
*B41J 2/01* (2006.01)

(52) U.S. Cl.
USPC ..... 347/104; 347/101; 156/361; 156/510; 100/29; 271/9.1; 399/384

(58) Field of Classification Search
None
See application file for complete search history.

(56) References Cited

U.S. PATENT DOCUMENTS

| | | | | |
|---|---|---|---|---|
| 5,838,354 | A * | 11/1998 | Yamada et al. | 347/101 |
| 6,250,624 | B1 * | 6/2001 | Kiyohara et al. | 271/9.1 |
| 6,633,740 | B2 * | 10/2003 | Estabrooks | 399/384 |
| 2003/0221566 | A1 * | 12/2003 | Apel et al. | 100/29 |
| 2005/0024464 | A1 * | 2/2005 | Takagi | 347/104 |

FOREIGN PATENT DOCUMENTS

| | | | |
|---|---|---|---|
| JP | 2002-326408 | A | 11/2002 |
| JP | 2004-276396 | A | 10/2004 |
| JP | 2005-349832 | A | 12/2005 |
| JP | 2006-205358 | A | 8/2006 |
| JP | 2006-327080 | A | 12/2006 |

* cited by examiner

*Primary Examiner* — Matthew Luu
*Assistant Examiner* — John P Zimmermann
(74) *Attorney, Agent, or Firm* — Canon U.S.A., Inc. IP Division

(57) ABSTRACT

A conveyance apparatus includes a holding unit configured to hold a roll sheet, a conveyance unit configured to convey the roll sheet in a first direction in which the roll sheet is unrolled and a second direction opposite from the first direction, and a control unit configured to control the drive of the conveyance unit. The amount of drive per unit conveyance distance at the time when the conveyance unit conveys the roll sheet is controlled so as to be larger in the conveyance in the first direction than in the conveyance in the second direction.

18 Claims, 9 Drawing Sheets

CONVEYANCE APPARATUS AND RECORDING APPARATUS

BACKGROUND OF THE INVENTION

1. Field of the Invention

The present invention relates to a conveyance apparatus used in a recording apparatus, and more specifically, it relates to an apparatus having a unit configured to correct the amount of conveyance.

2. Description of the Related Art

In the case where image recording is performed on a region of a recording medium (hereinafter referred to as sheet) and then image recording is performed again on the same region of the sheet, the sheet is to be conveyed in the opposite direction from a forward direction that is the conveyance direction at the time of recording, and then conveyed again in the forward direction. However, the amount of slippage between the sheet and the conveyance roller is different in the conveyance in the forward direction and the conveyance in the opposite direction, and therefore the start position of the second image recording is displaced from the start position of the first image recording. A technique to correct this displacement is known (see, for example, Japanese Patent Laid-Open No. 2006-205358). In the technique, before the first image recording and before the second image recording, a specific pattern is printed. On the basis of the amount of misalignment between the patterns, the start position of the second image recording is corrected.

In the case of the technique disclosed in Japanese Patent Laid-Open No. 2006-205358, detection patterns are to be printed on a sheet. Therefore, extra sheets and ink are consumed. In addition, the user may have to perform troublesome operation, such as the input of the amount of misalignment.

SUMMARY OF THE INVENTION

In an aspect of the present invention, a conveyance apparatus includes a holding unit configured to hold a roll sheet, a conveyance unit configured to convey the roll sheet in a first direction in which the roll sheet is unrolled and a second direction opposite from the first direction, and a control unit configured to control a drive of the conveyance unit. An amount of drive per unit conveyance distance at a time when the conveyance unit conveys the roll sheet is controlled so as to be larger in the conveyance in the first direction than in the conveyance in the second direction.

Further features of the present invention will become apparent from the following description of exemplary embodiments with reference to the attached drawings.

DESCRIPTION OF THE EMBODIMENTS

Figure 1:
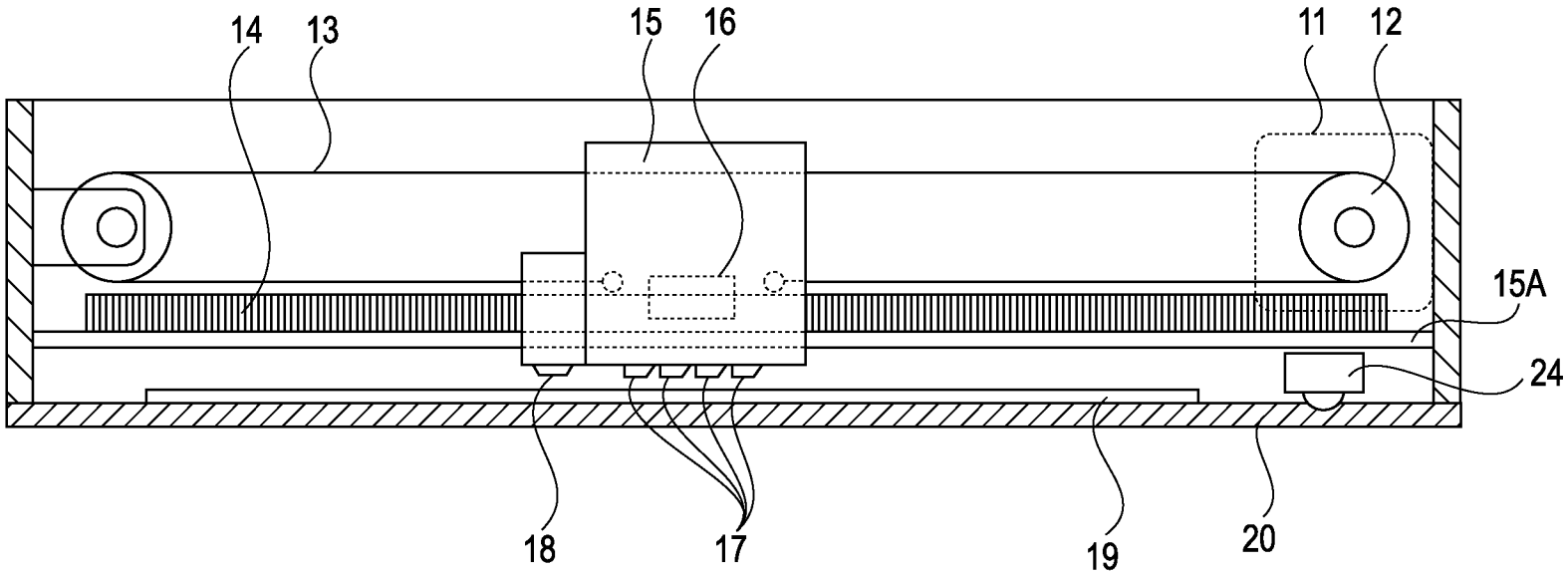
FIG. 1 is a schematic configuration diagram of a recording apparatus according to an embodiment of the present invention.
Figure 2:
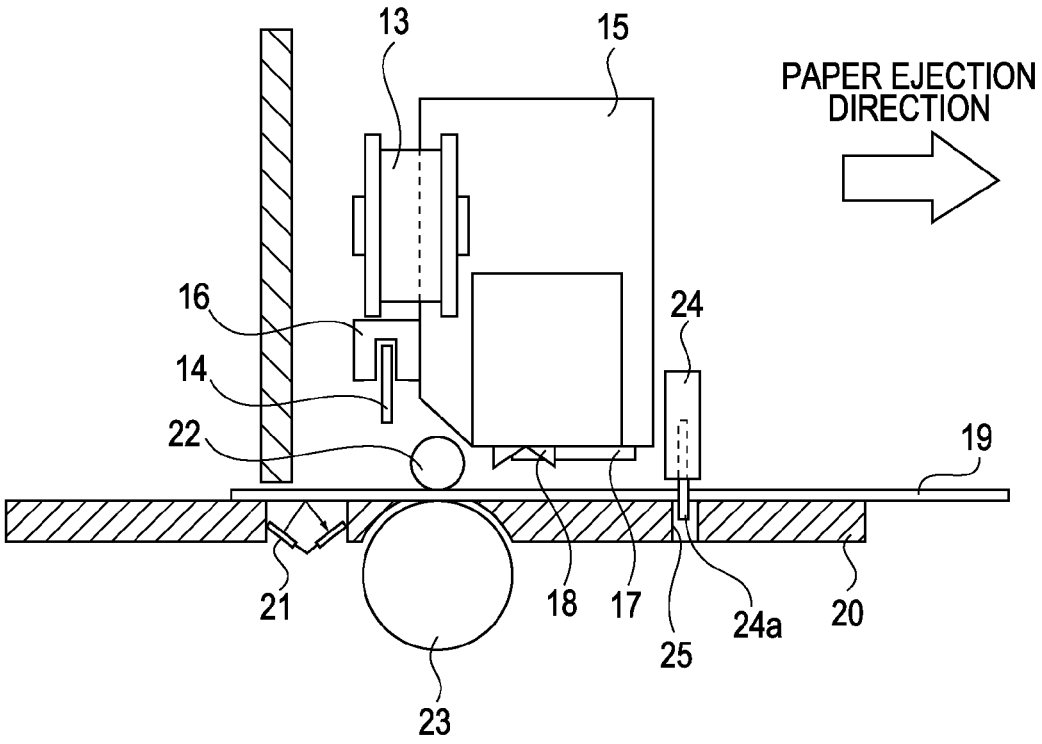
FIG. 2 is a schematic configuration diagram (side view) of the recording apparatus.

An ink jet recording apparatus that is an embodiment of the present invention will be described with reference to FIGS. 1 and 2. A plurality of ink jet recording heads 17 serve as recording units. The recording heads 17 are mounted on a carriage 15. The plurality of recording heads 17 each have discharge ports from which ink is discharged onto a sheet 19 serving as a recording medium. The sheet 19 is a roll sheet rolled up on a hollow core 19*a*. The hollow core 19*a* is rotatably supported by a shaft 19*b* serving as a holding unit.

The carriage 15 is supported movably along a guide 15A in the main scanning direction. The carriage 15 is reciprocated by a belt 13 that is looped over a pulley 12 that is rotationally driven by a motor 11. On the carriage 15 is mounted an optical (photo-) sensor unit 18 that measures the edge of the sheet 19. A conveyance roller 23 serves as a conveyance unit configured to convey the sheet 19. A pinch roller 22 presses the sheet against the conveyance roller 23. A cutter unit 24 has a cutter 24*a* that cuts the sheet 19. A platen 20 is provided with an optical sensor unit 21 and a cutter groove 25. When a cut sheet is loaded, the optical sensor unit 21 detects the rear edge of the cut sheet. At the time of sheet cutting, the blade of the cutter 24*a* passes through the cutter groove 25.

A linear scale 14 is disposed along the direction in which the carriage 15 scans. A linear scale sensor 16 is mounted on the carriage 15 and detects slits formed in the linear scale 14. When the carriage 15 moves, the linear scale sensor 16 detects the slits of the linear scale 14, thereby detecting the position of the carriage. The position (timing) of ink discharge is managed mainly on the basis of the output of a linear encoder that includes the linear scale 14 and the linear scale sensor 16. For example, when the carriage 15 detects a slit at a point on the linear scale 14, the ink discharge control is started. When the carriage 15 detects a specific slit of the linear scale 14, respective colors of ink are discharged from the ink discharge ports. When the carriage 15 detects a slit at a point on the linear scale 14, the ink discharge control is ended. The positions where ink discharge is started and ended are limited by the sheet position detected by the optical sensors 18 and 21, the amount of set margin, and the like, and are set on the basis of preliminarily created image data.

Figure 3:
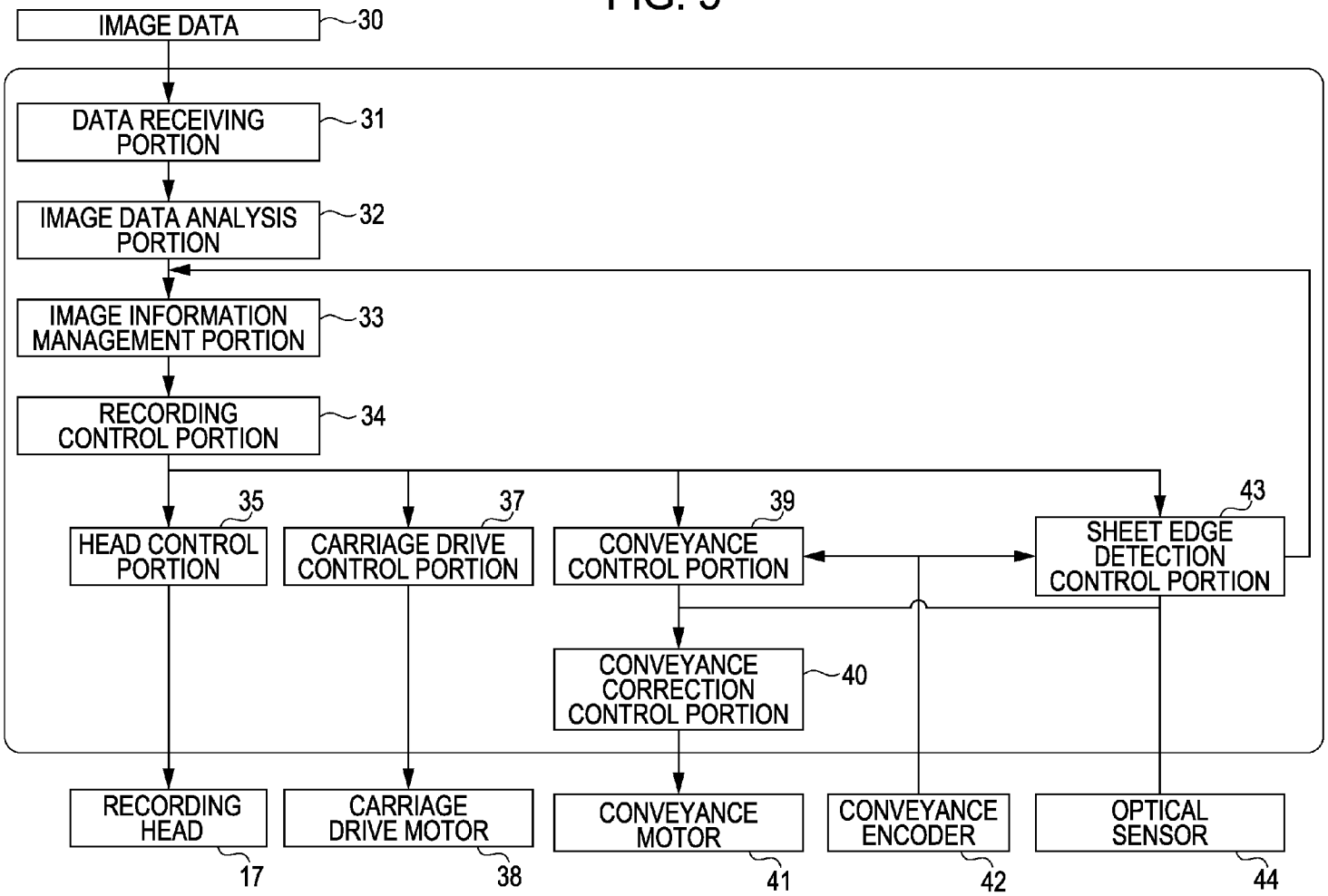
FIG. 3 is a control block diagram of the recording apparatus.

FIG. 3 is a control block diagram of the recording apparatus. A control apparatus 45 serving as a control unit has an image data receiving portion 31, a head control portion 35, a carriage control portion, and a sheet conveyance control portion 39. The image data receiving portion 31 receives external input data such as image data 30. The received external input data are analyzed in an image data analysis portion 32 into a controllable data group. Specifically, the image data analysis portion 32 extracts information associated with printing, such as the image data size, sheet type information, multipath information, and a conveyance correction value, from the image data 30.

An image information management portion 33 manages the data extracted from the image data 30 by the image data analysis portion 32, and sheet edge position information obtained from a sheet edge detection control portion 43, which is information used to determine the printing position and the like.

A recording control portion 34 is a portion that controls basic operation as a recording apparatus, and performs control, such as signal processing for recording, and driving of the recording operation mechanism, on the basis of data analyzed in the image information management portion 33. The head control portion 35 is a portion that controls a recording head 36 used in the recording apparatus, and performs ink discharge based on a command from the recording control portion 34, temperature management of the recording head 36, and the like. A carriage drive control portion 37 performs position control of a carriage drive motor 38 that controls the position of the recording head 36, on the basis of a command of the recording control portion 34.

The conveyance control portion 39 performs position control of a sheet conveyance motor 41 on the basis of a command of the recording control portion 34. A conveyance correction control portion 40 calculates a correction value of the amount of drive (the amount of rotation) of a conveyance motor 41 calculated on the basis of a theoretical value in the conveyance control portion 39. Taking into account the conveyance error due to the slippage of the sheet at the time of conveyance, the difference among machines, and the like, and according to the amount of drive, the correction value is added (or subtracted). In addition, on the basis of the information of the sheet edge detection control portion 43, a correction value at the time of conveyance is calculated. The details will hereinafter be described. The sheet edge detection control portion 43 turns on/off an optical sensor 44 that detects the sheet edge, on the basis of a command of the recording control portion 34. In addition, the sheet edge detection control portion 43 detects the sheet edge from the detection value of the optical sensor 44, reads the sheet position at the time of sheet edge detection with a conveyance encoder 42, and informs the image information management portion 33 and the conveyance control portion 39. The optical sensor 44 in FIG. 3, which serves to detect the front edge of the sheet, is the same as the optical sensor 18 in FIGS. 1 and 2.

Figure 4A:
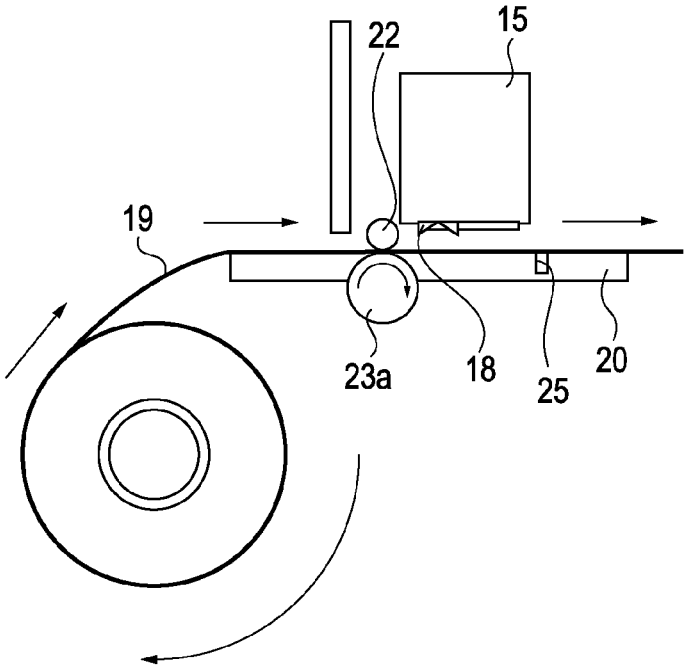
FIGS. 4A and 4B illustrate the forward and backward conveyance of a roll sheet in the recording apparatus.
Figure 4B:
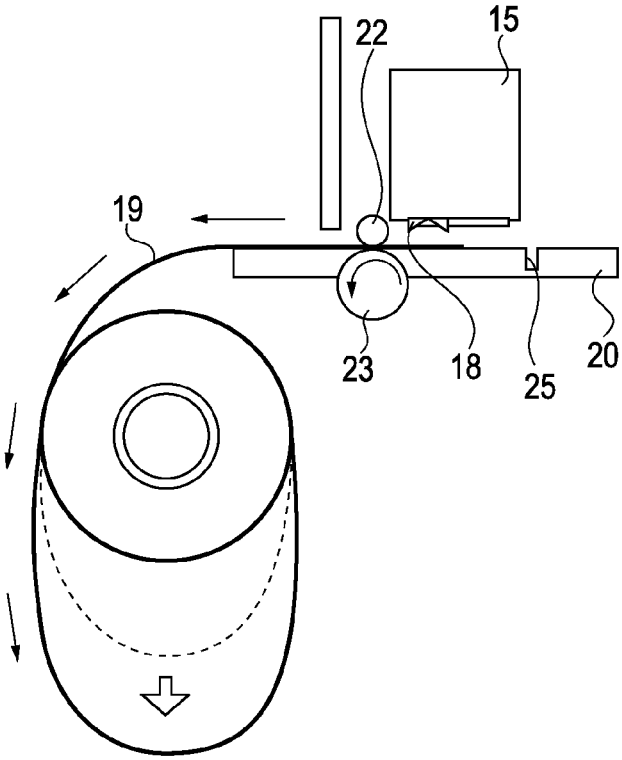

Next, the recording operation will be described. FIG. 4A is a sectional view of the apparatus showing how the sheet 19 (hereinafter, the sheet 19 is a roll sheet 19 unless otherwise noted) behaves when conveyed in a predetermined conveyance direction (when fed forward). FIG. 4B is a sectional view of the apparatus showing how the sheet 19 behaves when conveyed in the opposite direction from the conveyance direction (when fed backward).

In FIG. 4A, the roll sheet 19 is fed forward in a first direction in which the roll sheet 19 is unrolled. The conveyance motor 41 is driven, the conveyance roller 23 is rotated in the clockwise direction in the figure, and the sheet is conveyed in the ejection direction. At the time of recording, conveyance and stoppage are repeated. At the time of stoppage, the recording heads 17 perform ink discharge while the carriage motor 38 scans the carriage 15 in the width direction of the roll sheet. The roll portion of the roll sheet 19 does not have a unit configured to rotate the roll portion, and the roll portion is rotated by the rotation of the conveyance roller 23. Therefore, the load due to the rotation of the roll portion is imposed on the portion nipped between the pinch roller 22 and the conveyance roller 23.

Figure 6A:
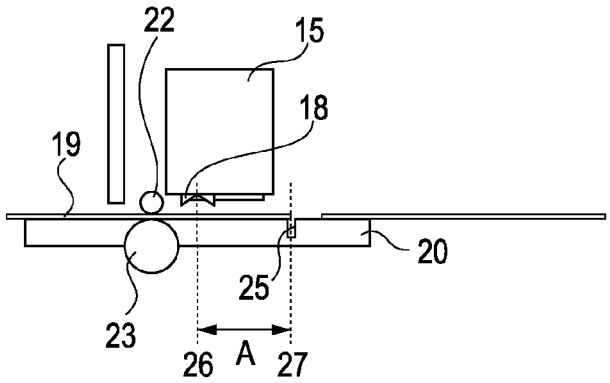
FIGS. 6A to 6D illustrate the pushing-out operation.
Figure 6B:
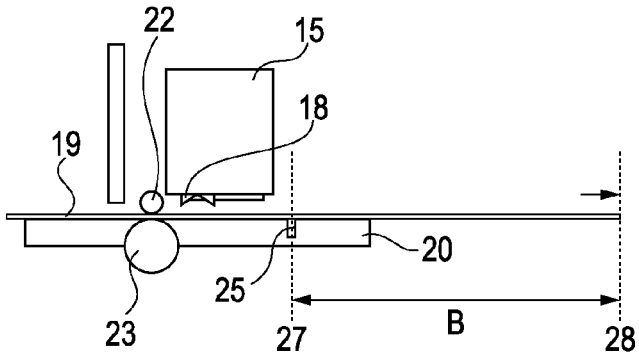
Figure 6C:
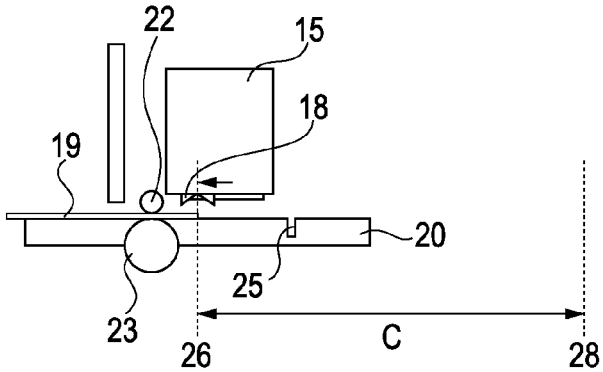
Figure 6D:
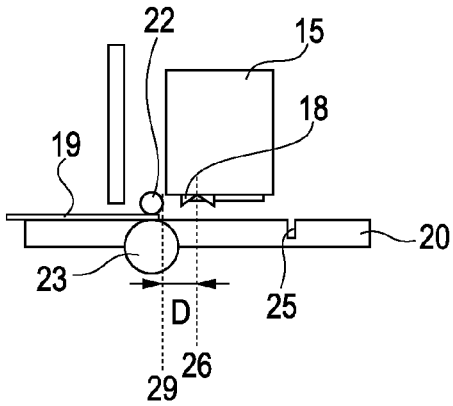

After the recording, as shown in FIG. 6A, the rear edge of the image on the sheet is conveyed to the cutting position, and cutting by the cutter 24*a* is performed. After the cutting by the cutter 24*a*, the cut sheet is pushed out. As shown in FIG. 6B, the conveyance roller 23 conveys the sheet until the front edge of the sheet moves from the cutting position 27 to the pushing-out position 28. At this time, by the front edge of the moving sheet, the cut sheet is pushed out and dropped on an ejection portion. Next, as shown in FIG. 6D, the conveyance roller 23 feeds the sheet backward in a second direction opposite from the first direction until the front edge of the sheet is located at a waiting position 29 upstream of the recording heads 17.

In FIG. 4B, when feeding the roll sheet 19 backward, the conveyance motor 41 is driven in the opposite direction from the direction at the time of forward feed, the conveyance roller 23 is rotated in the counterclockwise direction, and the sheet is conveyed in the opposite direction from the sheet ejection direction. Since the roll portion of the set roll sheet 19 does not have a unit configured to rotate the roll portion, slack occurs on the roll sheet conveyance route. To prevent the slack on the roll sheet conveyance route, the roll portion may be fed backward with a rewind mechanism (not shown) so that the roll sheet 19 is wound up on the roll portion. At the time of backward feed, a load mainly due to the weight of the part of the sheet downstream of the conveyance roller 23 is imposed on the pinch roller 22 and the conveyance roller 23.

The amount of conveyance (conveyance distance) by the conveyance roller 23 can be calculated from the diameter and the amount of rotation (rotation angle) of the conveyance roller if there is no slippage between the conveyance roller 23 and the sheet. For example, the theoretical value of the rotation angle of the conveyance roller per unit conveyance distance can be obtained by calculating the rotation angle of the conveyance roller to convey the sheet by a unit conveyance distance when the conveyance roller conveys the sheet without slipping, on the basis of the diameter of the conveyance roller. The theoretical value of the amount of drive of the motor (the rotation angle of the output shaft of the motor) per unit conveyance distance can be calculated from the theoretical value of the rotation angle of the conveyance roller per unit conveyance distance. That is to say, it can be calculated from the theoretical value of the rotation angle of the conveyance roller per unit conveyance distance and the reduction ratio of a gear train or the like that transmits drive from the motor to the conveyance roller. In this specification, the amount of drive is a value that can describe both the rotation angle of the conveyance roller and the rotation angle of the output shaft of the motor that drives the conveyance roller.

However, the roll sheet 19 is practically conveyed by the frictional force between the roll sheet 19 and the conveyance roller 23, and therefore slippage (hereinafter referred to as sheet slippage) occurs between the roll sheet 19 and the peripheral surface of the pinch roller 22 according to the conveyance load. Therefore, the actual amount of conveyance (conveyance distance) is smaller than the theoretical value calculated from the diameter and the amount of rotation (rotation angle) of the conveyance roller. To control the amount of conveyance by the conveyance roller 23 more accurately, the calculated amount of rotation is to be corrected by adding the amount of correction due to sheet slippage to the theoretical value or multiplying the theoretical value by a conveyance correction factor. By correction, the amount of rotation of the conveyance roller 23 per unit conveyance distance is made larger than the theoretical value.

Between the forward feed of the roll sheet in FIG. 4A and the backward feed of the roll sheet in FIG. 4B, there is a significant difference in the conveyance load of the roll sheet 19, and there also is a difference in the amount of sheet slippage at the time of conveyance. In this embodiment, the sheet pushing-out operation after the roll sheet cutting is performed, and therefore long-distance backward feed is performed to convey the front edge of the roll sheet to the waiting position. To prevent the throughput from decreasing significantly, conveying the front edge of the roll sheet to the waiting position by backward feed without stopping or decelerating may be performed. The reason is that deceleration or stoppage is used to detect the front edge position of the roll sheet with a sensor or the like and to correct the position information during the backward feed. Therefore, in this embodiment, using a backward-feed-specific correction factor or correction value, the amount of rotation of the conveyance roller at the time of backward feed conveyance is corrected.

Figure 5:
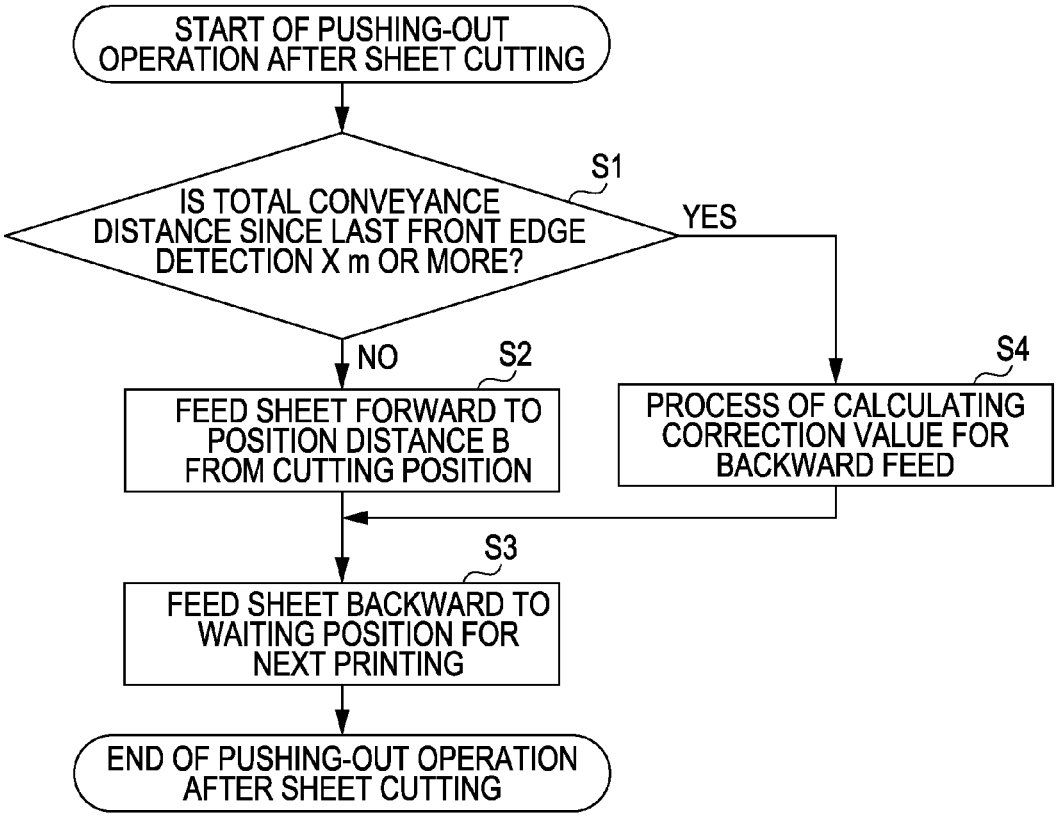
FIG. 5 is a flowchart illustrating the pushing-out operation.

FIG. 5 is a flowchart illustrating the pushing-out operation. The correction factor KF at the time of forward feed and the correction factor KB at the time of backward feed are preliminarily stored in the memory. In step S1, it is determined whether the total distance of conveyance by the conveyance roller 23 since the start of use of the present correction factor is X m or more. If the conveyance distance is X m or more (YES in step S1), it is presumed that the correction factor KB is to be changed due to the consumption of the roll sheet and the wear and deterioration of the conveyance roller 23. Therefore, step S4 is proceeded to and a new correction factor is calculated. The details will hereinafter be described.

If the conveyance distance is less than X m (NO in step S1), step S2 is proceeded to and the conveyance roller 23 conveys the sheet until the front edge of the sheet moves from the cutting position 27 to the pushing-out position 28. The amount of rotation of the conveyance roller 23 for conveyance is calculated using the correction factor KF for forward feed. In step S3, the conveyance roller 23 feeds the roll sheet backward until the front edge of the roll sheet is located at the waiting position 29. At this time, the conveyance roller 23 is rotated without stopping or decelerating by the amount of rotation calculated using the correction factor KB for backward feed.

Next, the content of step S4 will be described in detail. The position of the front edge of the sheet just after the sheet cutting is shown in FIG. 6A. The distance A from the sheet cutting position 27 to the position of the sheet front edge detection by the optical sensor 18 is 50 mm in this embodiment. The distance B from the cutting position 27 to the sheet pushing-out position 28 of FIG. 6B is 300 mm. The distance C from the pushing-out position 28 to the position 26 of the front edge detection by the sensor 18 of FIG. 6C is 350 mm.

When the conveyance roller 23 conveys the sheet, the amount of rotation of the conveyance roller 23 is counted by the conveyance encoder 42. The conveyance encoder 42 has a disk provided on the rotating shaft of the conveyance roller 23 or a gear that transmits drive from the conveyance motor 41 to the conveyance roller 23. Marks or slits provided at regular intervals along the outer circumference of the disk are read with a sensor, and marks passing through the sensor are counted. The amount of rotation of the disk is proportional to the amount of rotation of the conveyance roller 23. Therefore, by counting the marks of the disk, the amount of rotation of the conveyance roller 23 can be detected indirectly. In this embodiment, the resolution of conveyance by encoder count is 9600 dpi.

From these conditions, the amount of rotation (rotation angle) of the conveyance roller used to pull back the sheet by 350 mm, as a theoretical value that does not take sheet slippage into account, is converted into the count number (denoted by L) of the conveyance encoder as follows:

$$L=350/25.4\times9600\approx132283 \quad \text{(Expression 1)}$$

Actually, the encoder count number in the case of conveyance from the sheet pushing-out position 28 to the sheet front edge detecting position 26 is obtained as follows. If the count value of the conveyance encoder 42 in the state of FIG. 6B is denoted by a, and the count value of the encoder 42 at the time when the sensor 18 detects the front edge of the sheet is denoted by b, the absolute value of (a−b) is the count number used for conveyance.

Any unit configured to obtain the count value of the conveyance encoder at the time of sheet front edge detection can be used as long as it obtains the value of the conveyance encoder at the time of sheet front edge detection. For example, a unit configured to periodically monitor the optical sensor 18 and obtains the value of the conveyance encoder at the time of sheet front edge detection, or a unit in which an interruption handler is launched at the time of sheet front edge detection and the value of the conveyance encoder is obtained by internal processing thereof, can be used.

The conveyance correction value (factor) K that takes into account the sheet slippage at the time of backward feed is obtained using the following expression:

$$K=|(a-b)|/L \quad \text{(Expression 2)}$$

For example, if a=3365626 and b=3233125, $$K=|(3365626-3233125)|/132283=1.001647\ldots\approx1.00165 \quad \text{(Expression 3)}$$

In the subsequent backward feed of the roll sheet, conveyance control that takes into account the sheet slippage at the time of backward feed can be performed by correcting the amount of conveyance of the conveyance roller using the conveyance correction value K. In step S4, a conveyance correction factor K is obtained in this way.

Figure 7:
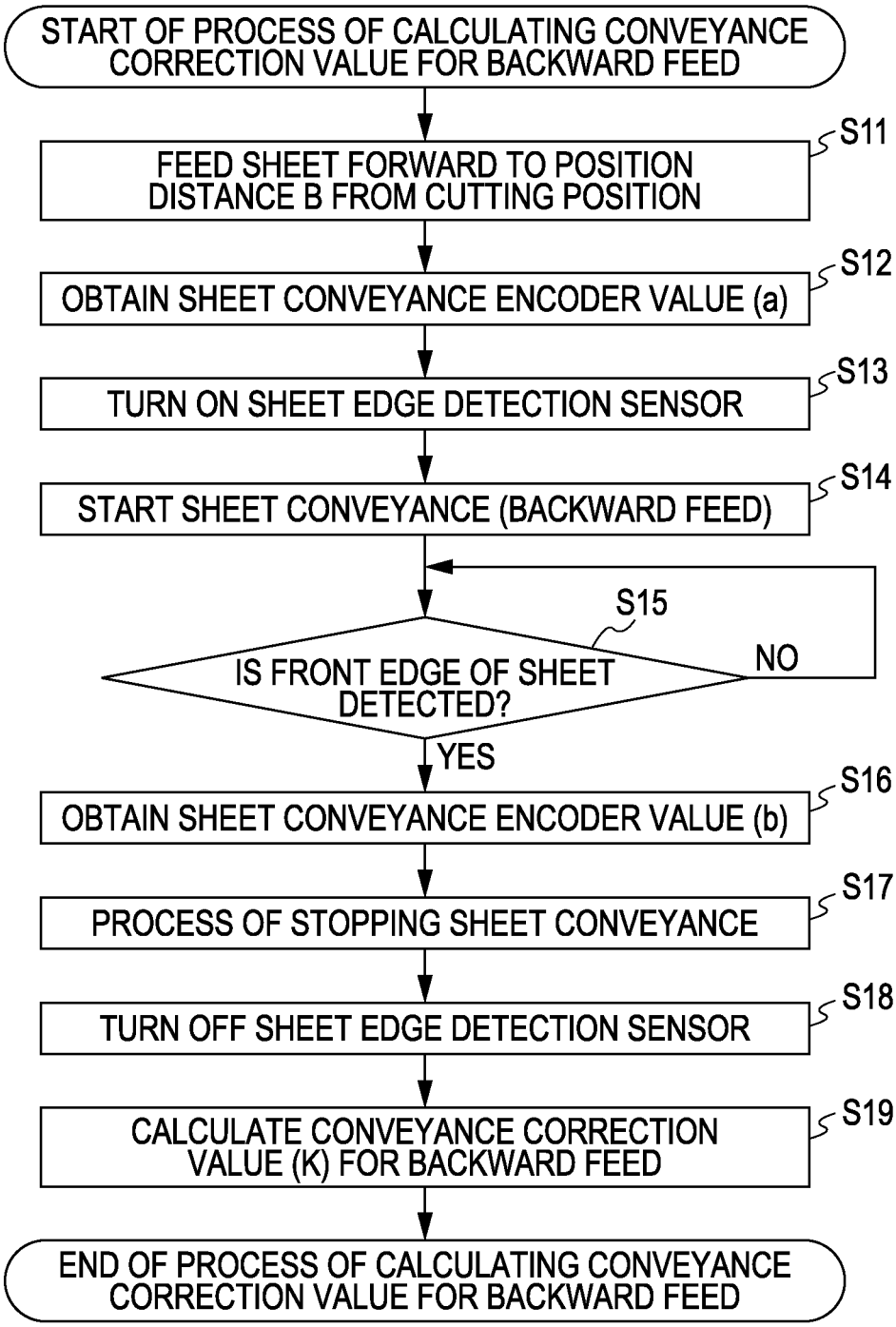
FIG. 7 is a flowchart illustrating the calculation of a correction factor at the time of backward feed.

This is shown specifically in the flowchart of FIG. 7. In step S11, just after the sheet cutting, the front edge of the sheet is fed (conveyed) forward to the sheet pushing-out position 28. In step S12, the count value a of the encoder 42 at the sheet pushing-out position 28 is obtained and read into the memory. In step S13, the optical sensor 44 is turned on so that it can detect the front edge of the sheet.

In step S14, the sheet is fed backward. At this time, to detect the front edge of the sheet with the optical sensor 44, the sheet is conveyed at a velocity lower than that of the backward feed in step S3.

In step S15, it is determined whether the front edge of the sheet is detected by the optical sensor 44. If the front edge of the sheet is detected (YES in step S15), the next step is proceeded to. In step S16, the count value b of the encoder 42 just after the sheet front edge detection is obtained.

In step S17, the backward feed for sheet front edge detection is stopped. In step S18, the optical sensor 44 is turned off to terminate the sheet front edge detection.

In step S19, to calculate the conveyance correction value (K) at the time of backward feed, the conveyance correction control portion 40 obtains the counter values (a) and (b) of the conveyance encoder 42 from the conveyance detection portion 43. From the counter values a and b and the theoretical value L of the amount of conveyance to detect the front edge of the sheet, the conveyance correction value (K) is calculated using the expression 2.

After calculating the conveyance correction value (K) in step S19, step S3 of the flowchart of FIG. 5 is returned to. In step S3, using the conveyance correction value (K), the amount of conveyance from the pushing-out position 28 to the sheet waiting position 29 is calculated, and the front edge of the sheet is returned to the sheet waiting position 29.

Specifically, if the distance from the optical sensor 18 to the sheet waiting position in FIG. 6D is 20 mm, the distance is 370 mm. Therefore, the amount of conveyance of the conveyance roller (encoder count value) in the case of backward feed is:

$$370/25.4\times9600\times1.00165=140073.259\ldots\approx140073 \quad \text{(Expression 4)}$$

In the subsequent sheet pushing-out process, a transition is made from step S1 to steps S2 and S3, and the front edge of the sheet is returned to the waiting position without stopping or decelerating using the calculated conveyance correction value K. Since the need for the operation to detect the front edge of the sheet at the time of pulling back is eliminated, the front edge of the sheet can be conveyed to the sheet waiting position of FIG. 6D at a normal sheet pulling-back velocity without stopping.

When the sheet is conveyed from the position of FIG. 6B to the position of FIG. 6C where the front edge is detected, the sheet is conveyed by 350 mm at a velocity lower than the velocity of normal pulling back without sheet front edge detection. For example, in the case of the sequence of the flowchart of FIG. 5 in this embodiment, the conveyance velocity in the case where front edge detection is performed in step S4 is 50 mm/sec, and the time consumed for backward feed by 350 mm is about 7 seconds. In contrast, if the normal pulling-back velocity in the case where steps S2 and S3 are proceeded to is 120 mm/sec, the time consumed for backward feed by 350 mm is about 2.9 seconds.

When detecting the front edge, conveyance is stopped at the time point of front edge detection and thereafter continued to the sheet waiting position. This causes a further time loss of about one second. If the front edge detecting operation is omitted in the pulling back after the pushing-out operation, the throughput is expected to improve by about 5.1 seconds (7+1−2.9).

Since the amount of conveyance is corrected at the time of backward feed, this embodiment is also effective for the case where a printed output is fed backward by the conveyance roller and then overprinting is performed on the same place. In addition, it is not necessary to print test patterns or the like that have no relation to print data, and to consume extra ink, for calculating a correction value. Further, the user need not perform operation.

Figure 8:
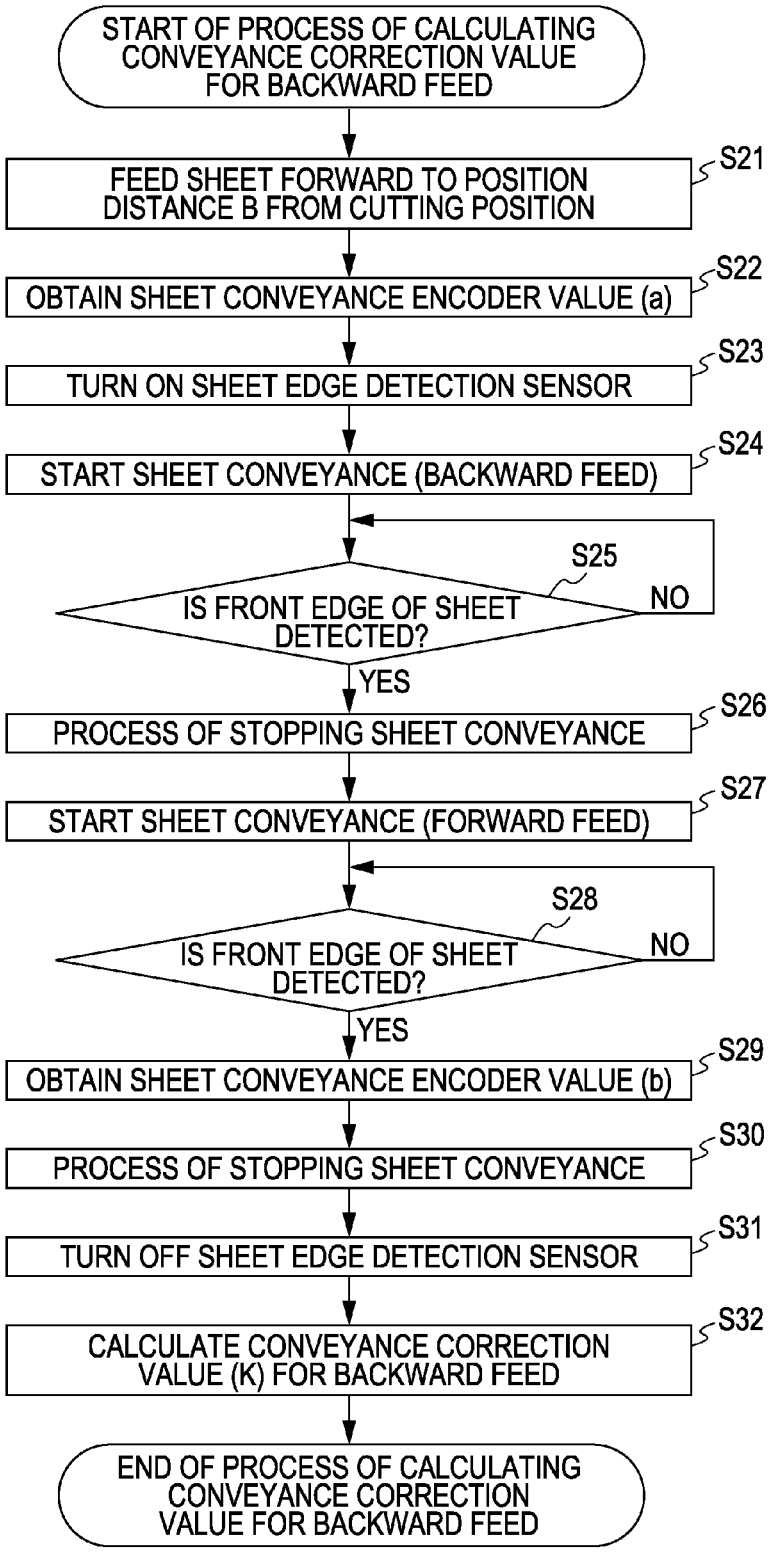
FIG. 8 is a flowchart illustrating the calculation of a correction factor with backlash taken into account.

The drive of the conveyance motor 41 is transmitted to the conveyance roller 23 by a gear train. Usually, a gear train has backlash. Backlash can be nonnegligible when detecting the front edge of the sheet, due to the individual difference among products or the change over time. When detecting the front edge with backlash taken into account, the sheet is to be conveyed not backward but forward. Specifically, the front edge of the sheet is detected in the backward feed at the time of pushing-out operation, and after stopping the conveyance, the front edge of the sheet is detected in the forward feed. The conveyance encoder value at the time of the detection in the forward feed is denoted by (b). By calculating a conveyance correction value using the value (b), the backlash caused by backward feed after forward feed can be canceled. FIG. 8 is a flowchart illustrating a method for calculating a backward-feed-specific conveyance correction value that takes backlash into account. Steps S21 to S25 are the same as steps S11 and S15 of FIG. 7. In step S26, the backward feed is stopped. In step S27, while feeding the sheet forward, the front edge of the sheet is detected with the optical sensor 44 again. In step S28, it is determined whether the front edge of the sheet is detected. If the front edge of the sheet is detected (YES in step S28), step S29 is proceeded to, where the sheet edge detection control portion 43 obtains the sheet position (b) just after the sheet front edge detection from the conveyance encoder 42. In step S30, the forward feed for detecting the front edge of the sheet is stopped.

Figure 9:
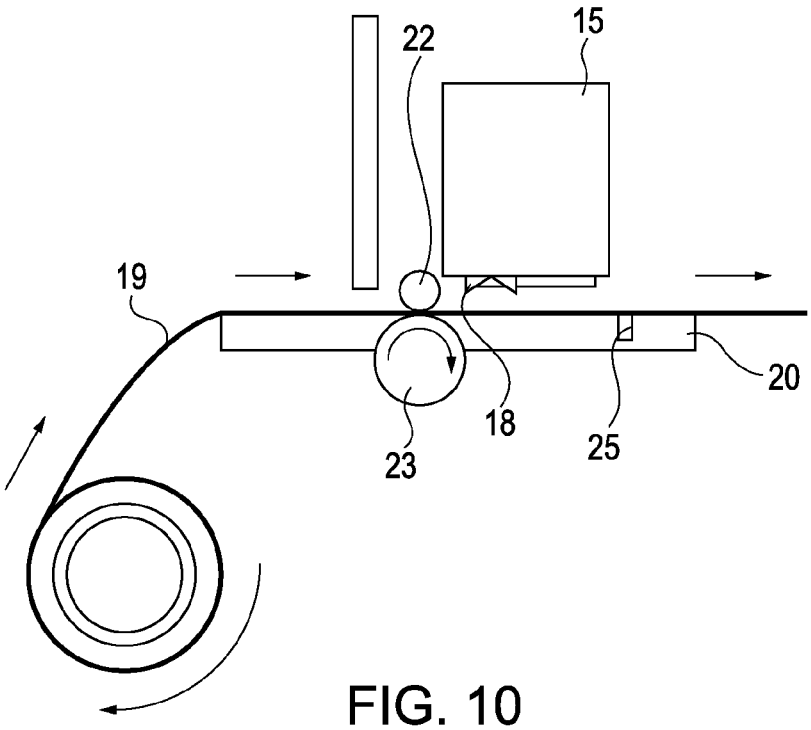
FIG. 9 illustrates the recording apparatus with the roll sheet consumed.

Steps S31 and S32 are the same as steps S18 and S19 of FIG. 7. After a roll sheet is set, the calculation of a conveyance correction value (factor) at the time of backward feed in this embodiment is to be performed not once but periodically until the roll sheet is replaced. The reason is that, as shown in FIG. 9, the weight of the roll portion of the roll sheet 19 decreases with the consumption of the roll sheet, and the amount of paper slippage per unit drive of the conveyance roller at the time of forward feed decreases with the decreasing weight of the roll portion of the roll sheet 19. For this reason, the difference in the amount of sheet slippage per unit drive of the conveyance roller between the forward feed and backward feed decreases with the consumption of the roll sheet. This causes an error in the pushing-out operation after the sheet cutting, and when conveying the sheet to the sheet waiting position. This error is significant depending on the type of the sheet.

To prevent trouble due to the error, a conveyance correction value is to be newly calculated at the time of the sheet cutting after the sheet has been conveyed by a predetermined amount (X m) or more since the calculation of a conveyance correction value by the front edge detection in this embodiment.

Figure 10:
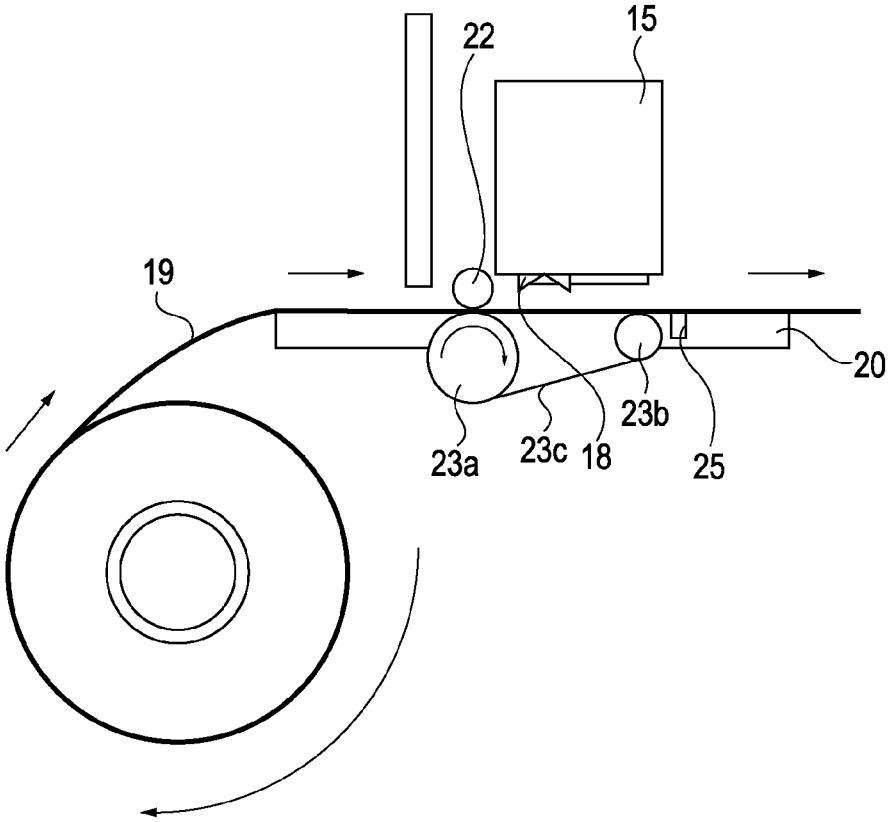
FIG. 10 is a schematic configuration diagram of a second embodiment.

FIG. 10 shows a second embodiment. In this embodiment, instead of the conveyance roller 23, a conveyance belt serves as a conveyance unit. A conveyance belt 23*c* is looped over a driving roller 23*a* and a driven roller 23*b*.

The control block diagram of FIG. 3 and the control flowcharts of FIGS. 5, 7, and 8 of the first embodiment can be used for the second embodiment if the conveyance roller 23 is replaced with the driving roller 23*a*. The driving roller 23*a* driven by the conveyance motor 41 drives the conveyance belt 23*c*. The surface of the conveyance belt 23*c* is charged by a charging unit, and the sheet is electrostatically attracted to the surface of the conveyance belt 23*c*.

After the recording of an image on the sheet attracted to the conveyance belt 23*c*, the sheet is cut by the cutter unit 24, and the cut portion is pushed out by the pushing-out operation. As in the first embodiment, a correction factor for correcting the amount of drive at the time of backward feed is calculated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-050920 filed Mar. 4, 2009, which is hereby incorporated by reference herein in its entirety.

What is claimed is:

1. A recording apparatus comprising:

a supporting unit for supporting a roll sheet;

a conveyance unit configured to convey the roll sheet in a first direction in which the roll sheet is unrolled and a second direction opposite from the first direction;

a control unit configured to control a drive of the conveyance unit;

a recording unit configured to record an image on the conveyed roll sheet;

a cutter configured to cut off a portion of the roll sheet, where the image is recorded, to form a first front edge, the cut-off portion being pushed out to a first position by the first front edge of the roll sheet conveyed in the first direction;

a detecting unit configured to detect the first front edge of the roll sheet which is conveyed in the second direction; and a calculation unit configured to calculate an amount of drive of the conveyance unit that conveys the first front edge of the roll sheet from the first position to a second position where the first front edge is detected, wherein the control unit obtains a correction factor calculated based on the amount of drive of the conveyance unit and a distance from the first position to the second position.

2. The recording apparatus according to claim 1, wherein the recording unit performs recording in an ink jet manner.

3. The recording apparatus according to claim 1, wherein the cutter cuts off another portion of the roll sheet to form a second front edge, and the control unit controls a drive of the conveyance unit to convey the second front edge of the roll sheet from the first position in the second direction by using the correction factor.

4. The recording apparatus according to claim 3, wherein the control unit controls the conveyance unit so that the first front edge is conveyed at a first velocity in the second direction and the second front edge is conveyed at a second velocity which is higher than the first velocity.

5. The recording apparatus according to claim 1, further comprising a memory to store a predetermined correction factor, and the obtained correction factor is replaced with the predetermined correction factor.

6. The recording apparatus according to claim 5, wherein, depending on a total distance of conveyance executed by the conveyance unit, the predetermined correction factor is replaced with the obtained correction factor.

7. The recording apparatus according to claim 3, further comprising a memory to store a predetermined correction factor, wherein, after the predetermined correction factor has been replaced with the obtained correction factor, the second front edge of the roll sheet is conveyed from the first position to a third position via the second position in the second direction.

8. The recording apparatus according to claim 7, wherein the second front edge of the roll sheet is conveyed from the first position to the third position without stopping the conveyance of the second front edge of the roll sheet.

9. The recording apparatus according to claim 1, wherein the amount of drive of the conveyance unit is obtained by using a conveyance encoder.

10. The recording apparatus according to claim 1, wherein the supporting unit is rotated according to rotation of the conveyance unit to convey the roll sheet in the first direction and the supporting unit is not rotated according to rotation of the conveyance unit to convey the roll sheet in the second direction.

11. The recording apparatus according to claim 1, wherein the first position is a pushing-out position.

12. The recording apparatus according to claim 1, wherein the second position is a detection position.

13. The recording apparatus according to claim 7, wherein the third position is a waiting position for recording an image.

14. A recording apparatus comprising:

a conveyance unit configured to convey a sheet in a first direction and a second direction opposite from the first direction;

a control unit configured to control a drive of the conveyance unit;

a recording unit configured to record an image on the conveyed sheet;

a cutter configured to cut off a portion of the sheet, where the image is recorded, to form a first front edge, the cut-off portion being pushed out to a first position by the first front edge of the sheet conveyed in the first direction;

a detecting unit configured to detect the first front edge of the sheet which is conveyed in the second direction; and a calculation unit configured to calculate an amount of drive of the conveyance unit that conveys the first front edge of the sheet from the first position to a second position where the first front edge is detected, wherein the control unit obtains a correction factor calculated based on the amount of drive of the conveyance unit and a distance from the first position to the second position.

15. The recording apparatus according to claim 14, wherein the cutter cuts off another portion of the sheet to form a second front edge, and the control unit controls a drive of the conveyance unit to convey the second front edge of the sheet from the first position in the second direction by using the correction factor.

16. The recording apparatus according to claim 15, wherein the control unit controls the conveyance unit so that the first front edge is conveyed at a first velocity in the second direction and the second front edge is conveyed at a second velocity which is higher than the first velocity.

17. The recording apparatus according to claim 14, further comprising a memory to store a predetermined correction factor, and the obtained correction factor is replaced with the predetermined correction factor.

18. The recording apparatus according to claim 17, wherein, depending on a total distance of conveyance executed by the conveyance unit, the predetermined correction factor is replaced with the obtained correction factor.

* * * * *